United States Patent [19]

Hoaglund

[11] 4,106,413

[45] Aug. 15, 1978

[54] MULTI-POSITION TABLE

[76] Inventor: Neal B. Hoaglund, R.F.D. Box 3646, Nelson Rd., Boyne City, Mich. 49712

[21] Appl. No.: 857,375

[22] Filed: Dec. 5, 1977

[51] Int. Cl.[2] ..... A47B 3/00

[52] U.S. Cl. ..... 108/12; 108/132; 108/19; 312/195; 248/439

[58] Field of Search ..... 108/11, 12, 19, 133, 108/130, 65, 131, 92, 132, 116, 115, 33, 34, 35, 36; 312/194, 195; 248/439

[56] References Cited

U.S. PATENT DOCUMENTS

| | | | |
|---|---|---|---|
| 76,459 | 4/1868 | Hubbard | 108/132 |
| D. 165,707 | 1/1952 | Buehler | 312/194 X |
| 1,458,449 | 6/1923 | Snyder | 312/194 |
| 2,527,505 | 10/1950 | Wilkinson | 108/19 |
| 3,614,047 | 10/1969 | Hitze | 248/439 |
| 3,865,051 | 2/1975 | Johl et al. | 108/132 |

FOREIGN PATENT DOCUMENTS

| | | | |
|---|---|---|---|
| 972,415 | 8/1975 | Canada | 108/132 |
| 880,030 | 12/1942 | France | 108/12 |

*Primary Examiner*—Roy D. Frazier
*Assistant Examiner*—Peter A. Aschenbrenner
*Attorney, Agent, or Firm*—Paul L. Sjoquist

[57] ABSTRACT

A table apparatus having a flat top surface and leg structures hinged thereto, whereby the leg structures may be pivotally moved to at least three stable positions, providing a variable table top height, surface area and functional utilization. The leg structures may have built in shelves and receptacles for additional utilitarian purposes.

11 Claims, 3 Drawing Figures

FIG. 1
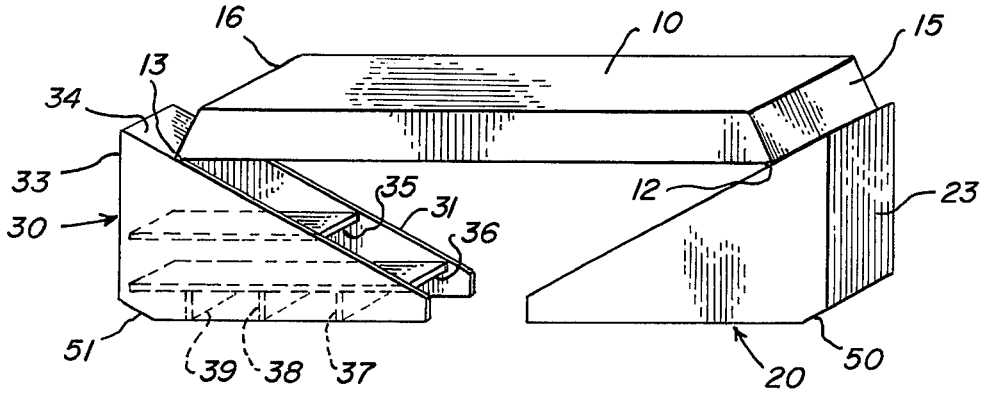
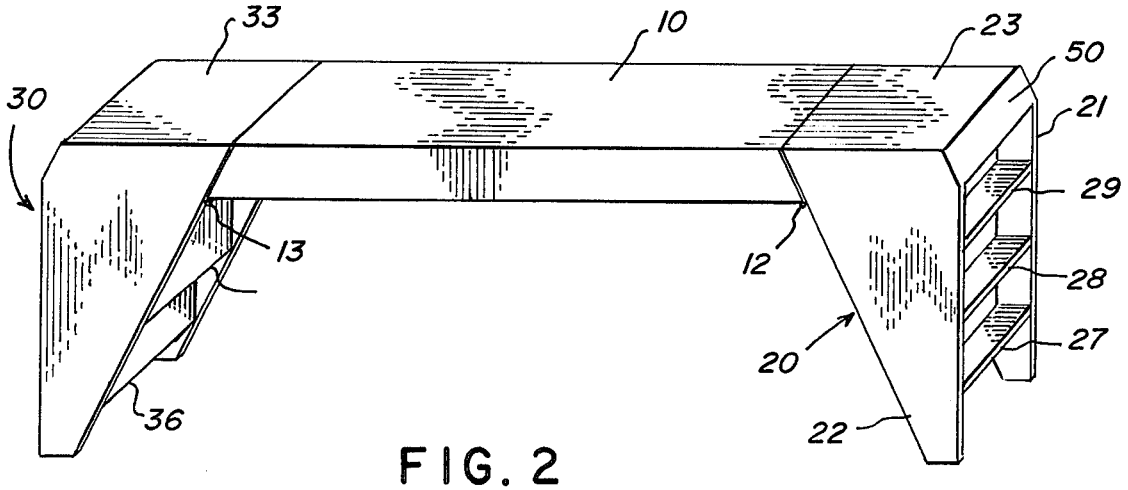
FIG. 2
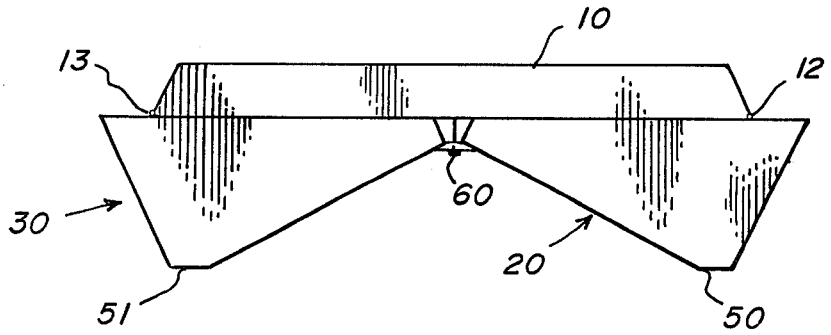
FIG. 3

MULTI-POSITION TABLE

BACKGROUND OF THE INVENTION

This invention relates to a novel table structure, and more particularly to a table having pivotal legs which may be positioned to provide at least three functional table uses.

Tables having folding members forming a part thereof are well known in the prior art, particularly where such folding members are intended for reducing the overall volume occupied by the table to facilitate storage in a smaller volume. To a similar extend tables having top surfaces hinged for increasing the overall top surface area when the table is in use are also very common. Tables of the first type frequently have folding legs which compactly fold against the top surface to create a narrow form for storage, and tables of the second type typically have table top surface members which hinge and hang downwardly adjacent a fixed top surface when not in use. Tables which utilize hinged members for decorative purposes and for the purpose of providing different utilitarian forms are less common in the prior art. The present invention relates to this class of tables, wherein folding members not only change the decorative aesthetic form of the table, but also provide a plurality of functional uses for the table in the various forms which may be adopted.

SUMMARY OF THE INVENTION

The invention comprises a table having a first top surface area of fixed and predetermined size, having hinged thereto leg members which may be pivoted into more than one support positions. The leg members are shaped so as to provide a supplementary top surface extension in one of their positions, and to provide different top surface elevations in each of the positions. The leg members may be adapted for providing additional shelf and storage space to the table.

It is therefore a principal object of this invention to provide a table having multiple forms for decorative and aesthetic purposes. It is another object of this invention to provide a table wherein each of the decorative forms has a distinct functional utility. It is yet another object of this invention to provide a table having a selectable top surface area and a selectable top surface elevation. It is also an object of this invention to provide a table having the foregoing advantages wherein the table may be quickly converted from one of its forms into another of its forms.

BRIEF DESCRIPTION OF THE DRAWINGS

The foregoing objects and purposes of the invention are accomplished in the preferred embodiment disclosed herein, and with reference to the appended drawings, in which:

FIG. 1 is an isometric view of the invention in one of its positions;

FIG. 2 is an isometric view of the invention in a second position; and

FIG. 3 is a front elevational view of the invention in a third position.

DESCRIPTION OF THE PREFERRED EMBODIMENT

Referring first to FIG. 1, the invention is shown in isometric view in one of its stable mounting positions. A table top 10 has rigid side panels 15 and 16 which are respectively pivotally attached at hinge 12 to leg structure 20 and at hinge 13 to leg structure 30. Table top 10 alternatively may be of solid construction throughout, having inclined sides 15 and 16 as shown in FIG. 1. Table top 10 may be of any convenient width, but the distance between the hinges 12 and 13 must be maintained so as to permit proper clearance between leg structures 20 and 30 in the lowered positions. Sides 15 and 16 are sloped downwardly from table top 10, the angle A preferably being 120° or slightly less. In one construction of the preferred embodiment herein the angle A was made 116 ½°, which produced a slope of sides 15 and 16 adequate for purposes to be hereinafter described.

Hinges 12 and 13 are preferably piano-type hinges, extending across the entire lower edge of sides 15 and 16, and attached to the adjacent material of leg structures 20 and 30 respectively. Leg structures 20 and 30 are sized so as to provide a desired table height dimension in the respective alternative positions.

Leg structures 20 and 30 are identical and therefore a description of one of them, leg structure 30, will be made herein. Leg structure 30 includes support panels 31 and 32 rigidly attached to end member 33. End member 33 is a solid surface identical to end member 23 of leg structure 20 shown in FIG. 1, preferably made from the same surface material as table top 10. A solid panel 34 also is attached between support panels 31 and 32 and is secured to end member 33 for construction rigidity. Panel 34 may be either positioned parallel to the sloping sides of panels 31 and 32, or parallel to the floor surface as shown in FIG. 1. Preferably, hinge 13 is secured to the edge of panel 34. A bridging shelf 36 is also rigidly attached between support panels 31 and 32 to form a structurally strong and self supporting leg structure 30 which may be pivotally mounted about hinge 13. Alternatively, additional shelves such as shelf 35 may be placed between support panels 31 and 32, and shelves such as 37, 38, 39 may be perpendicularly aligned relative to shelf 36 for structural support and functional use as will be hereinafter described.

In the position shown in FIG. 1, the table materials are sized so as to provide an elevation for table top 10 of approximately 16 inches.

FIG. 2 shows an isometric view of the table in a second stable position. In this position, leg structures 20 and 30 are pivotally raised to bring end members 23 and 33 into adjacent alignment with table top 10 and thereby provide a table extension surface. The height of table top 10 in this position is approximately 24 inches, and the slope of the table top sides 15 and 16 bearing against the respective edges of leg structures 20 and 30 provides a stable structure for the table in this position. Of course, leg structure 20 may optionally be constructed to have shelves 27, 28, and 29 as have hereinbefore been described with reference to leg structure 30. With the table in the position shown in FIG. 2, the table top surface area is increased by about 50 percent over the surface area in the position shown in FIG. 1.

FIG. 3 showns an elevational view of yet a third position for the apparatus. In this position, leg structures 20 and 30 are pivoted about hinges 12 and 13 respectively to rest on beveled edges 50 and 51. A locking mechanism 60, of a type known in the art such as a wing nut and bolt, is threaded into the underside of table top 10 and clamped against leg structures 20 and 30 to hold them in the position shown. The height of top surface 10 in this position is slightly less than the height of the surface in the position shown in FIG. 1.

In operation, the table may be selectively adjusted to any of the positions shown herein by merely pivoting leg structures 20 and 30 about their respective hinges. In the positions shown in FIGS. 1 and 3, the table is adaptable for use as a cocktail table having either of two decorative forms. Of course, the optional inner shelves described herein provide additional functional utility for the position of FIG. 1. When leg structures 20 and 30 are pivoted about their respective hinges to form the table position shown in FIG. 2, the table is adaptable for use as a serving table. In this position the optional end shelves shown in the figures provide additional functional utility for the table. It is to be understood that a solid end member or leg opening may be substituted for shelves 27, 28, and 29 of leg structure 20 and shelves 37, 38, and 39 of leg structure 30.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A table adapted for multiple positions, comprising a top surface having two opposite ends sloped downwardly and outwardly relative to said top surface; a hinge attached along the bottom of each of said sloped table ends; and a leg structure attached to each of said hinges, each of said leg structures constructed from generally triangular-shaped members with said hinge attachment along one triangular edge so as to permit said triangular edge to pivotally contact a sloped table end.

2. The apparatus of claim 1, wherein said each of said leg structures further comprise two generally triangular-shaped members spaced apart in rigid attachment by an intermediate panel extending therebetween along edges adjacent said edges contacting said sloped table end, whereby said intermediate panel forms an adjacent extension to said top surface.

3. The apparatus of claim 2, wherein said top surface sloped ends are positioned at an approximate angle of 120° relative to said top surface.

4. The apparatus of claim 2, wherein said leg structures each further comprise generally triangular-shaped members of identical size but having unequal length edges with two of said edges being perpendicular relative to each other, and said hinge attachment being made along a non-perpendicular edge.

5. The apparatus of claim 4, wherein said leg structures each further comprise a plurality of shelves extending between said triangular shaped members.

6. The apparatus of claim 5, further comprising locking means for securing said leg structures in a fixed position relative to said top surface.

7. A multiple-position table having predetermined selectable elevational positions, comprising (a) a table top having two opposite ends downwardly and outwardly sloping from a top surface;

(b) a hinge attached along the lower edge of each of said sloped ends;

(c) a pair of leg structures, each respectively attached to a hinge, and each comprising (i) a pair of identical generally triangularly-shaped surface members (ii) a separator surface member rigidly mounted between said triangularly-shaped surface members along respective edges thereof;

(iii) means for attaching to said hinge, extending between said triangularly-shaped surface members along respective edges thereof adjacent said edges where said separator surface member is attached;

whereby the pivotal movement of said leg structure about said hinge brings said separator surface member into adjacent planar alignment with said top surface.

8. The apparatus of claim 7, wherein said generally triangular-shaped surface members further comprise generally right-triangle-shaped members.

9. The apparatus of claim 8, wherein said means for attaching to said hinge extends between said surface members along hypotenuse edges.

10. The apparatus of claim 9, further comprising a plurality of shelves extending between said triangularly-shaped surface members.

11. The apparatus of claim 10, further comprising means for securing said leg structures in a fixed position.

* * * * *